United States Patent [19]

Binasik et al.

[11] Patent Number: 4,726,761

[45] Date of Patent: Feb. 23, 1988

[54] METHOD AND APPARATUS FOR INTRODUCING COMBUSTION AIR INTO A COMBUSTION CHAMBER

[75] Inventors: Chester S. Binasik, Palo Alto; Londerville, Steve B., Half Moon Bay, both of Calif.

[73] Assignee: Coen Company, Inc., Burlingame, Calif.

[21] Appl. No.: 8,200

[22] Filed: Jan. 29, 1987

Related U.S. Application Data

[62] Division of Ser. No. 774,207, Sep. 9, 1985, Pat. No. 4,685,882.

[51] Int. Cl.[4] ..... F23M 3/00

[52] U.S. Cl. ..... 431/9; 431/182; 239/405

[58] Field of Search ..... 431/354, 182, 190, 201, 431/9, 252; 239/405, 400, 403, 404, 406; 110/347

[56] References Cited

U.S. PATENT DOCUMENTS 4,473,185 9/1984 Peterson et al. ..... 431/9

FOREIGN PATENT DOCUMENTS 14017 1/1985 Japan ..... 431/9

*Primary Examiner*—Henry A. Bennet

*Attorney, Agent, or Firm*—Townsend & Townsend

[57] ABSTRACT

A burner especially adapted for use with pulverized fuel slurries, such as pulverized coal-water slurries. The burner has an atomizing nozzle which disperses the slurry in the form of multiple, diverging spray cones issuing from a corresponding number of atomizing orifices. Each orifice is formed by a central atomizing air flow. The slurry is brought into contact with the air flow and is atomized thereby. Before the atomized air flow is discharged, it is enveloped by a rotating auxiliary air flow and constricted to generate a venturi effect which facilitates the formation of the diverging, cone-shaped discharge pattern. A combustion air spinner surrounds the nozzle and is constructed of multiple vanes which have circularly arcuate shapes and a length, in the direction of the air flow, which is least proximate the nozzle and greatest at the periphery of the vanes. This assures an even combustion air flow rate over the entire radial extent of the spinner. The spin rates induced by the blades increase in a radially outward direction by a factor of at least about 10 which generates a pressure gradient downstream of the spinner and radially outward of the burner axis towards which air discharged by the spinner is drawn. This generates a vortex along the burner axis which permits hot combustion gases to penetrate upstream towards the nozzle. Contact between the combustion gases and the nozzle is prevented by the air flow issuing from the spinner in the vicinity of the nozzle. A secondary combustion air envelope is formed by a register which surrounds the spinner and which limits the extent to which the combustion air through the spinner can expand downstream of the burner.

12 Claims, 4 Drawing Figures

METHOD AND APPARATUS FOR INTRODUCING COMBUSTION AIR INTO A COMBUSTION CHAMBER

This is a division of application Ser. No. 774,207 filed Sept. 9.1985 now U.S. Pat. No. 4,685,882.

BACKGROUND OF THE INVENTION

Pulverized fuel slurries, such as pulverized coal-water slurries, are easily transported, stored and handled and, therefore, have found increasing use. The combustion of such slurries, however, presents problems because they contain significant amounts of liquids, in the case of coal-water slurries they contain up to 30% (by weight) water. Before combustion can commence, the water must be vaporized. This requires a significant amount of heat which must be quickly transferred to the slurry particles to initiate and sustain combustion.

The remainder of this application will primarily discuss and describe coal-water slurries. However, the invention is not so limited. It is equally useful for other slurries such as, for example, coal-methanol slurries, coal-methanol-water slurries, or coal-oil slurries, to name a few. The term "pulverized fuel slurry", therefore, is meant and should be understood to include all slurries made up of pulverized solid fuels suspended in a liquid.

In addition, the term "pulverized fuel slurry" refers to a slurry or slurries which may contain certain additives to change the viscosity of the slurry, maintain the solid particles in suspension, etc.

It is conventional to fire pulverized fuel slurries (hereinafter sometimes also referred to as "slurry" or "slurries") by atomizing them, that is by finely dispersing the solids-liquid particles into a combustion chamber and, thereafter, igniting them. A problem typically encountered during the atomization of such slurries is that the atomized particles have a tendency to agglomerate, that is to stick to each other when impacted in either the slurry atomizer or the combustion chamber downstream thereof. Once agglomerated, they are virtually impossible to separate.

Agglomerated particles have an increased mass which renders it more difficult to maintain them suspended in the combustion chamber. As a result, they can fall out without complete combustion, foul furnace surfaces and reduce the overall efficiency of the burner. Even if the agglomerated particles do not fall out, they require significantly longer stay times in the flame zone of the combustion chamber before they are completely burnt. Frequently, such extended stay times are not available, particularly in furnaces converted from oil or gas operation to slurry operation.

A further problem associated with slurry burners is the need for the rapid transfer of significant amounts of heat to the atomized slurry particles immediately downstream of the nozzle to initiate combustion. For example, gas burners require the transfer of approximately 1% of the total heat release of the burner to the incoming gas to generate a self-sustaining flame. Oil burners require about 1.5% and pulverized coal burners approximately 2% of the total heat to sustain the flame. In contrast, pulverized coal slurries with a water content of approximately 30% require the transfer of approximately 5% of the total heat release to generate a self-sustaining flame.

The heat required to evaporate the water is obtained from the main combustion chamber and the surrounding furnace walls. The heat transfer is enhanced by generating a low pressure core zone about the burner axis downstream of the nozzle which draws hot combustion gases rearwardly into a "recirculation zone." The prior art accomplished this by employing combustion air spinners which surround the nozzle and which spin the air at a more or less uniform rate over the entire radial extent of the spinner. The result of such a construction is that a low pressure zone is created at the center of the spinner which extends upstream into the spinner so that most of the air is emitted by the spinner at the peripheral portion thereof. A problem encountered with such prior art spinners is that the low pressure zone typically extends along the burner axis rearwardly to and past the nozzle, a problem which increases as the spin number is increased. As a result, recirculation gases contact the nozzle, often unacceptably heat it, and cause a fouling thereof which leads to inefficiencies, possible flame-outs and, in turn, substantial burner downtimes.

The heating of the atomized slurry particles is enhanced by widely dispersing them as, for example, by providing the nozzle with a large number of atomizing orifices. This is difficult to implement with slurry nozzles, as contrasted with oil atomizing nozzles, for example, because the relatively large solid particle sizes (typically in the range of between 0.003" to as large as 0.010") require relatively large orifice diameters and because the abrasive characteristics of solid fuel particles require the use of special, abrasion resistant material inserts, which limit the number of orifices which can be placed in the nozzle. Thus, there can only be a limited number of orifices, which must accommodate relatively large slurry flow rates. This increases the particle concentration in the atomized slurry cone downstream of the nozzle and thereby enhances the incidence of undesirable particle agglomeration.

Thus, there is at the present a need for an efficient slurry burner which achieves a self-sustaining flame without undue stay times for the atomized slurry particles and without fouling burner and furnace walls so that such burners can be used as a substitute for gas, oil and pulverized fuel burners in existing furnaces, for example.

SUMMARY OF THE INVENTION

The present invention provides a slurry burner which is efficient, relatively low in initial and operating costs, and which prevents the fouling of furnace and burner surfaces which surround the flame. Its characteristics are such that it can replace oil, gas or pulverized fuel burners in existing furnaces without compromising efficiency.

Broadly speaking, a first aspect of the present invention contemplates the provision of a slurry atomizing nozzle constructed so that nozzle surfaces are protected from abrasion by solid fuel particles which pass through the nozzle. The atomized slurry is dispersed from the nozzle in a wide-angle cone-like pattern (with an angle which is preferably in the range of between about 12° to 35°) from multiple orifices which are angularly inclined relative to the burner axis and, preferably, relative to each other. Additionally, the nozzle is constructed so that the angle of the conical discharge pattern for the atomized slurry can be regulated to take into account differing operating requirements, furnace loads and the like.

A second aspect of the present invention provides that incoming combustion air flows through an air spinner which concentrically surrounds the atomizing nozzle and which is constructed so that the air flow rate is substantially constant over the entire radial extent of the spinner on the discharge side thereof and at spin numbers which are least in the vicinity of the atomizing nozzle and greatest at the periphery of the spinner. This provides a twofold benefit.

First, the relatively large increase in the spin number between the center of the spinner and the periphery thereof expands the air flow downstream of the spinner because it generates a pressure gradient downstream of the spinner and radially outward of the burner axis. The pressure gradient draws the air flow at the center portion of the spinner shortly after it leaves the spinner in a radially outward direction as it propagates downstream. This promotes the rearward (or upstream) recirculation of hot combustion gases along the burner axis from the combustion chamber towards the nozzle.

The recirculating hot combustion gases greatly increase the rate at which heat is transferred to the atomized slurry particles (consisting of both solid fuel particles and liquid). Thus, combustion can commence only a short distance downstream of the nozzle.

Secondly, contact between the recirculating combustion gases and the nozzle is prevented by the relatively high air flow rate through the spinner at the center thereof, that is adjacent the nozzle, a feature not present in conventional spinners which have constant spin numbers over their entire radial extent. The fouling of the nozzle from recirculating combustion gases is thereby prevented.

Thus, a burner constructed in accordance with the present invention can be used in newly built furnaces or as a replacement for oil, gas or pulverized fuel burners in existing furnaces because heat is rapidly transferred to the atomized slurry and the incidence of undesirable particle agglomeration is greatly reduced. As a result, burner efficiency can be maintained while the combustion chamber size typically need not be significantly larger than what is necessary for gas or oil fired burners.

DESCRIPTION OF THE PREFERRED EMBODIMENTS

Figure 1:
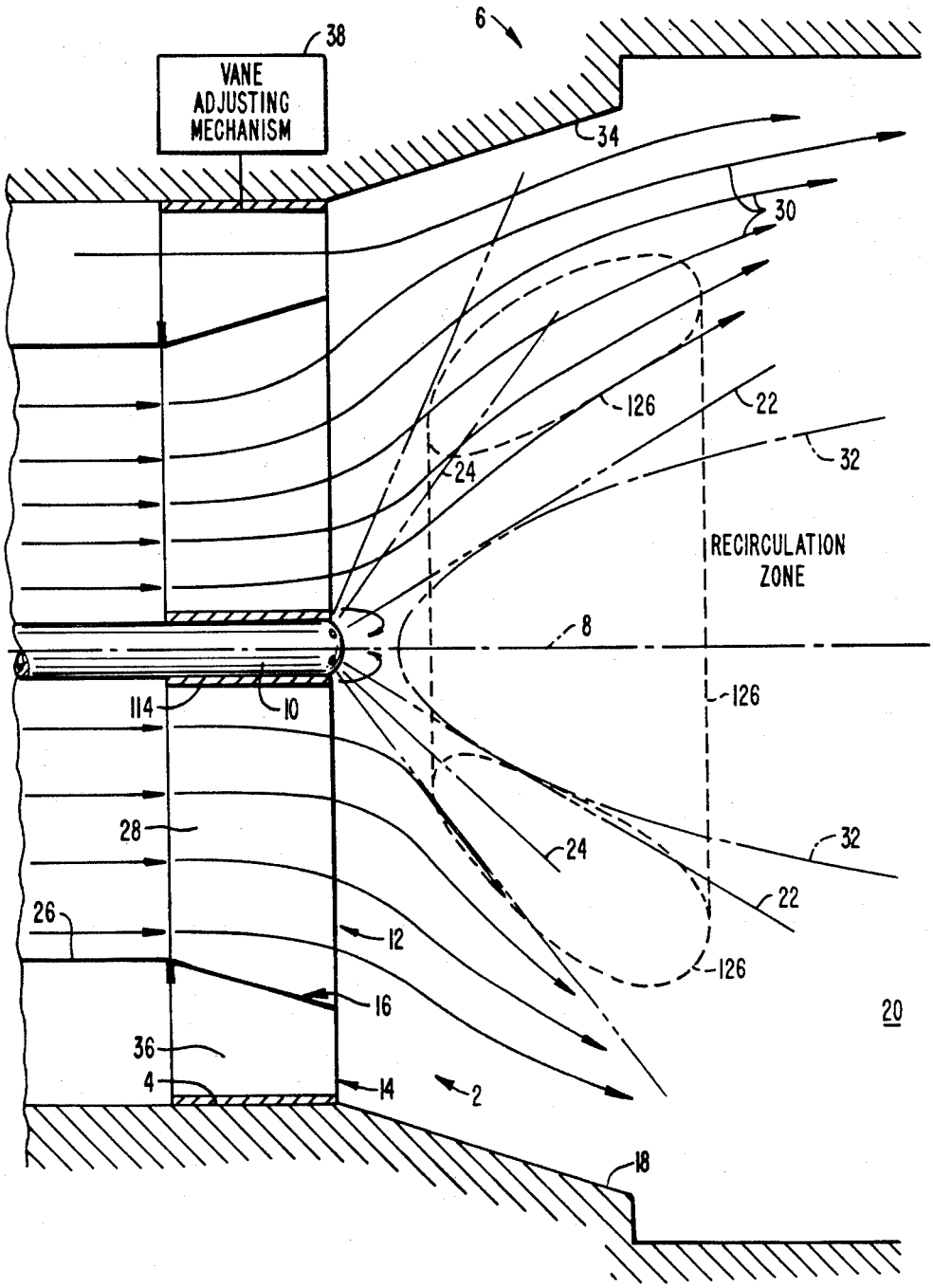
FIG. 1 is a schematic, side elevational view of a solid fuel slurry burner constructed in accordance with the invention.

Referring first to FIG. 1, a pulverized solid fuel slurry burner 2 constructed in accordance with the present invention is installed in a burner opening 4 of a furnace 6. The burner has an axis 8 and includes a slurry atomizing nozzle 10 and a coaxial combustion air spinner 12 which surrounds the nozzle. A secondary combustion air register 14 is coaxially disposed about the spinner and is separated therefrom by a cone 16.

In operation slurry is "atomized," that is the slurry is dispersed into fine slurry particles and discharged from the downstream facing end of the nozzle into a burner throat 18 and hence into a combustion chamber 20 of the furnace. As will be described in greater detail below, the atomized slurry is sprayed into the furnace in the form of a plurality of slurry spray cones 22, the axes 24 of which are angularly inclined relative to the burner axis 8. Primary combustion air flows through an air intake duct 26 from an appropriate source (not shown) to and through the spinner. The spinner has a multiplicity of air deflection vanes 28 which impart a rotary flow component to the combustion air so that it expands radially outward downstream of the spinner as is generally illustrated by primary combustion air flow lines 30.

The swirling combustion air creates a low pressure recirculation zone 32 downstream of the burner which, during firing, recirculates hot combustion gases from the combustion chamber rearwardly (in an upstream direction) as is generally illustrated by the elliptical line in FIG. 1. Slurry particles atomized by nozzle 10 are heated with radiant heat from the hot gases in the recirculation zone as well as from the hot walls 34 of the furnace surrounding the burner throat and the combustion chamber. As the particles are heated the liquid, e.g. water, is evaporated and the temperature of the remaining solids continues to rise to and above the flash point when ignition takes place and the flame becomes self-sustaining.

To prevent the swirling primary combustion air downstream of the burner and the slurry particles discharged by the nozzle from contacting or impacting on furnace walls 34 secondary combustion air is introduced through register 14. It envelopes the primary air and atomized slurry mixture and prevents undesirable contact thereof with the walls and a possible fouling and/or abrasion thereof. Preferably, the secondary combustion air register includes a multiplicity of vanes 36 which are operatively connected with a suitable vane adjusting mechanism 38 for varying the angularity of the vanes relative to the air flow. In this manner the secondary air flow can be adjusted to counter the rotation of the primary combustion air, for example, to restrict the extent to which the latter expands downstream of the burner which facilitates the operation of the burner under reduced load. The construction of such vane adjusting mechanisms is well known and, therefore, is not further shown or described herein.

Figure 2:
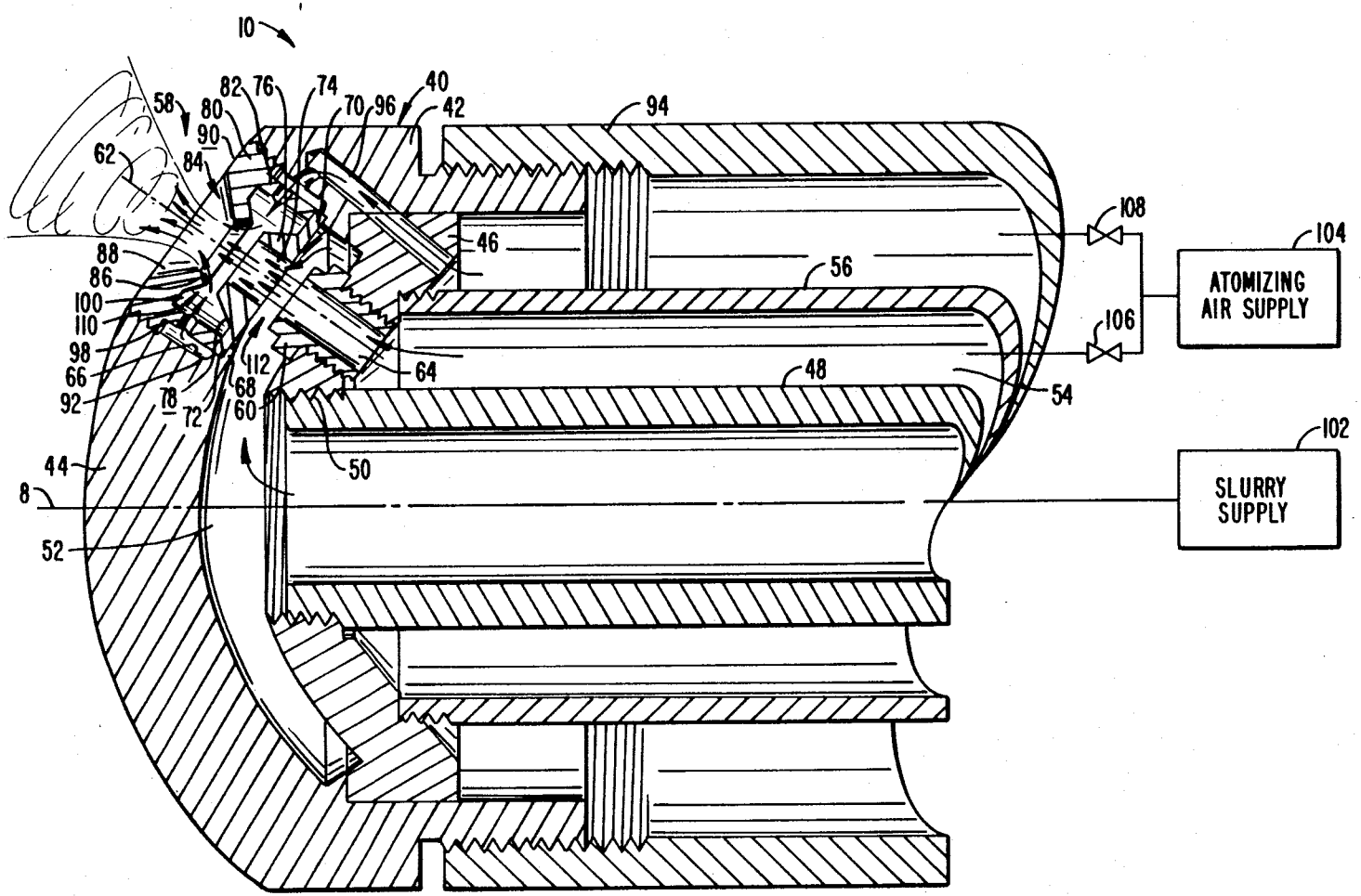
FIG. 2 is a side elevational, fragmentary cross-sectional view, on an enlarged scale, of a slurry atomizing nozzle constructed in accordance with the present invention and utilized in the burner shown in FIG. 1.

Turning now to the detailed construction of the burner and referring particularly to FIGS. 1 and 2, nozzle 10 is defined by a housing 40 which has a cylindrical, tubular section 42 and a closed end cap 44 that faces in a downstream direction. An internal insert 46 is disposed within the housing and suitably secured thereto with bolts, pins or the like (not shown). The insert has a threaded, central aperture to which a slurry supply pipe 48 is secured, for example, with threads 50. The downstream facing end of the insert is spaced apart from the end cap 44 of the housing to define a generally disk-shaped slurry flow space 52 which communicates with the slurry supply pipe and which extends radially outward to approximately the cylindrical housing portion 42.

A slurry atomizing gaseous medium, such as air, steam or natural gas, for example (hereinafter "atomizing air") is fed to the nozzle through an annular space 54 between the slurry pipe 48 and an inner air supply tube 56 the downstream end of which is threaded to an upstream facing end of internal insert 46. A plurality of slurry atomizing orifices 58 are formed in the nozzle.

Each atomizing orifice is defined by an air inlet nipple 60 threaded into the internal nozzle insert 46 concentric with an orifice axis 62. The nipple includes a central atomizing air hole 64.

An outward opening, generally cylindrical recess 66 in the end cap is concentric with orifice axis 62 and includes, at its inner end, an inwardly protruding, ring-shaped lip 68. A circular groove 72 in the lip positions a disk 70 concentrically with the orifice axis 62. The disk has a central aperture 74 that is coaxial with air hole 64 in nipple 60 and which extends through a center section 76 of the disk that has an increased thickness relative to the remainder of the disk. The center section has a frustoconical shape and includes a conical side surface 78 which converges in a downward direction for purposes more fully described below.

An orifice plate 80 is threaded into the end cap recess 66. It includes an annular skirt 82 which engages a peripheral portion of disk 70 and firmly seats the disk in groove 72 of lip 68 to thereby secure the disk in the end cap.

The orifice plate has an opening 84 which is coaxial with aperture 74 in disk 70 and air hole 64 in nipple 60. A first, frustoconically shaped upstream section of 86 of the opening converges in a downstream direction from the side of the orifice plate facing disk 70. A second, frustoconically shaped downstream section 88 of the opening is contiguous with the first section and diverges in a downstream direction to a discharge port defined by the orifice plate at the outer face 90 thereof.

Skirt 82 of the orifice plate has a lesser diameter than the inner wall of end cap recess 66 to define an annular auxiliary air supply chamber 92 between the skirt and the recess wall. The air chamber communicates with an auxiliary air intake pipe 94 threaded to the upstream end of nozzle 10 via a bore 96. The skirt includes a plurality of air inlet openings 98 which discharge the air into a ring-shaped air supply chamber 100 between the disk 70 and the orifice plate 80. The orifices are positioned so that the air is discharged into the ring-shaped chamber in a tangential direction to induce rotation of the air about the orifice axis 62.

In use, the slurry pipe 48 is conventionally connected to a slurry supply 102 and the inner and outer air tubes 56 and 94, respectively, are coupled to an atomizing air supply 104 via independently operable air flow control valves 106, 108. The air valves are manually or automatically operated as is most suitable for a particular installation.

When valve 106 is opened, atomizing air flows through the annular space 54 and hence through air hole 64, disk aperture 74, and orifice plate opening 84 of each atomizing orifice 58 to the exterior of the nozzle, that is into the combustion chamber of the furnace. When valve 108 is opened, auxiliary air flows along auxiliary (outer) air pipe 94, through bore 96 and annular space 92 into tangentially oriented inlet openings 98 in skirt 82 and hence into the ring-shaped chamber 100 where the auxiliary air swirls about the orifice axis. From there the auxiliary air flows through a cylindrical slit 110 defined between the opposing faces of disk 70 and orifice plate 80 into the orifice plate opening 84 in a manner further described below.

Slurry flows from the slurry supply 102 through slurry pipe 48 into the disk-shaped slurry flow space 52. It fills the flow space and, therefore, flows under pressure through a cylindrical slit 112 defined between opposing faces of air inlet nipple 60 and disk 70 in a radially inward direction (relative to orifice axis 62). The atomizing air flow from air hole 64 to disk aperture 74 shears off the radially inwardly flowing slurry and atomizes it. Thus, a mixture of atomizing air and slurry particles flows through disk aperture 74 towards the discharge end of orifice 58 at outer orifice plate surface 90.

The swirling air flows in ring chamber 100 through air slit 110, envelopes the mixture flow issuing from disk aperture 74 and imparts a rotating motion to it. Further, the converging (upstream) section 86 of the orifice plate opening 84 constricts the rotating mixture flow in a venturi-like manner downstream of the converging section and generally within the confines of the diverging section 88 of the opening as is illustrated in FIG. 2. As the swirling slurry-atomizing air mixture propagates in a downstream direction past the point of maximum constriction, it diverges to define the earlier discussed spray cone 22.

The frustoconical surface 78 of disk 70 has an angular inclination which corresponds to the converging, angular inclination of hole section 86 in the orifice plate. This helps to directionalize the swirling air in ring chamber 100 in a converging fashion into the orifice plate opening and thereby facilitates the constriction and subsequent conical expansion of the mixture flow into the combustion chamber. In a presently preferred embodiment the angular inclination of these two surfaces is approximately 45°.

To minimize or eliminate abrasion damage to the nozzle from high speed solid fuel particles, those parts of the nozzle which can come in contact with them, e.g. disk 70, are preferably constructed of an abrasion resisting material such as carbide or ceramic.

Flow control valves 106, 108 are employed to adjust the flow rates for both the atomizing air and the auxiliary air. The valves also permit an adjustment of the relative flow rates so that the angle of spray cone 22 can be modulated to take into account differing operating conditions, variations in the burner load, etc. Alternatively, for a constant burner operation the atomizing air and the auxiliary air can utilize a common air supply. In such an event, the inner air tube 56 is dispensed with and the atomizing air supply is directly coupled to air pipe 94, with or without a flow control valve as may be desired.

Figure 3:
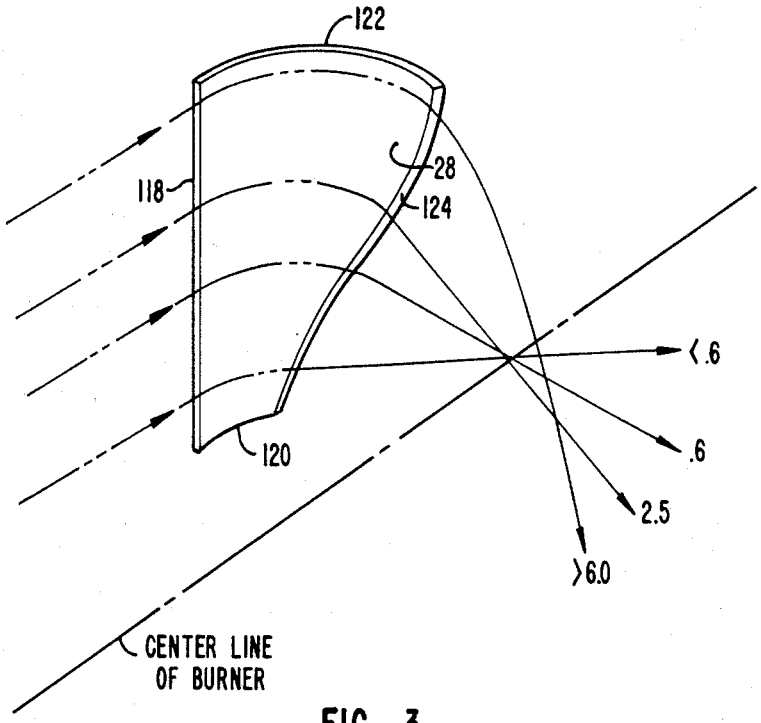
FIGS. 3 and 4 are fragmentary, schematic side elevational views of vanes constructed in accordance with the present invention and utilized in the combustion air spinner shown in FIG. 1.
Figure 4:
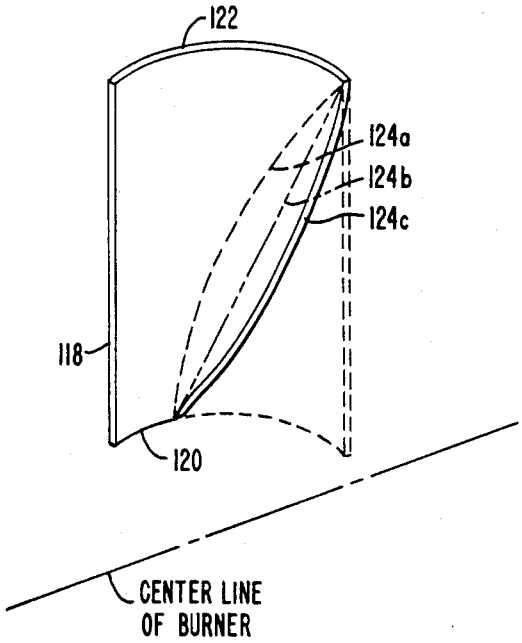

Turning now to FIGS. 1, 3 and 4, the construction and operation of spinner 12 will be set forth in detail. The spinner has inner and outer, cylindrical and radially spaced apart housing sections 114, between which a multiplicity of radially oriented spinner vanes 26 are mounted. The spinner housing is suitably mounted to the furnace, in the illustrated embodiment to the cone-shaped divider 16. The inner housing section 114 suitably supports atomizing nozzle 10.

Each vane has a straight, upstream facing edge 118 and a circularly arcuate or a partial cylindrical shape in the direction of air flow, that is about an imaginary radially oriented axis (not shown), as is best illustrated in FIG. 3. The length of the vanes varies in the flow direction; it is shortest at the radially innermost vane end 120 and longest at the radially outermost vane end 122. Thus, a rotational component is imparted to air flowing over the vanes, which is customarily measured in "spin numbers." As used in the industry, the spin number is defined as the ratio of the air's rotating momentum over its axial momentum.

In a presently preferred embodiment of the invention, each vane is constructed so that a spin number of less than 0.6, e.g. 0.4, is imparted to air flowing over the vane immediately adjacent its radially innermost edge 120 while a spin number of at least 6 and preferably in the range of between about 6–12 is imparted to air flowing past the vane immediately adjacent its radially outermost edge 122. The distribution of the spin numbers between the radial extremes of the vane can be adjusted to suit specific applications. Thus, a downstream edge 124 of each vane can be given a concave, straight or convex configuration 124*a*, 124*b* or 124*c* as is schematically illustrated in FIG. 4 to suitably adjust the spin numbers.

As the foregoing discussion illustrates, the vanes 28 are constructed so that the arc through which incoming combustion air is deflected varies between the radial extremes of the vanes. It is least adjacent the radially innermost edge 120. For a spin number of approximately 0.4 the deflecting vane arc for the air is in the range of between about 10°–30°. For a spin number at the radially outermost edge 122 in the range of between about 6–12 the air is deflected through an arc of between 75°–90°. The arc deflection for the air between the radial extremes of the vane varies accordingly. In one embodiment the spin number about one-third from the inner vane edge 120 is approximately 0.6 and the arc deflection for the air is between about 30°–50°. At about two-thirds from the radially inner edge 120 the desired spin number is 2.5 and the arc deflection is between about 55°–60°.

Turning now to the overall operation of the burner 2 of the present invention and referring to FIGS. 1–4, slurry is flowed from slurry supply 102 to nozzle orifices 58 and atomizing air valves 106, 108 are opened to flow atomizing air and auxiliary air to the orifices in the above-described manner. As a result, multiple atomized slurry cones are generated by the nozzle. The above-described relatively wide cone angle of about 30° minimizes or eliminates slurry particle agglomeration which could result if the cone angle is too small and the particle density within the cone is relatively large.

To prevent slurry particle agglomeration due to contact between the spray cones from adjacent nozzle orifices 58, it is preferred to alternatingly angularly offset the orifice axes 62, say by about 10°. Aside from reducing agglomeration, the alternating angular offset of the orifices provides space between the spray cones which permit the penetration of combustion air from spinner 12 to assure a sufficient oxygen supply for the coal particles and an efficient combustion.

Combustion air enters spinner 12 from conduit 26 and is rotated about the axis 8 of the burner by spinner vanes 28. Because of the above-discussed vane shape and distribution of spin numbers, air flowing proximate the burner axis is deflected a relatively small amount as compared with the deflection of the air towards the periphery of the spinner. As a result, air flowing along the center of the spinner encounters a relatively lesser flow resistance than peripheral portions of the air and, therefore, there is a relatively larger air flow rate at the center, particularly as compared with prior art spinners which did not seek to provide relatively low spin numbers at the center of the spinner.

The relatively high spin numbers of the spinner at the peripheral portions thereof generate a low pressure gradient downstream of the spinner and radially outward of the burner axis. The low pressure gradient is schematically illustrated by generally elliptical dotted lines 126 in FIG. 1. It should be understood, however, that the elliptical lines are not meant to and do not indicate a confined, stationary low pressure zone; rather, they are shown only to illustrate the general location of the low pressure gradient. The exact position of the low pressure gradient is a function of the average spin number of the spinner measured from the center to the periphery thereof, as well as the specific distribution of spin numbers as above-discussed. Generally, the low pressure gradient will move radially further outward as the spin numbers are increased, that is as the rotational movement imparted to the combustion air flowing through the spinner is increased.

The importance of the low pressure gradient in the combustion air emitted by the spinner is that it pulls the relatively large air flow at the center of the spinner in a radially outward direction a short distance downstream of the spinner. Thus, while the center air flow prevents the combustion gas recirculation zone from reaching far enough back to contact and interfere with the operation of the fuel discharge nozzle, it nevertheless permits it to extend back as far as possible while preventing undesirable fouling. Extending the recirculation zone that far back is desirable because it assists in the rapid heat transfer to the slurry particles, the quick evaporation of the liquid therein, and a heating of the particle to and above the flash point to initiate combustion.

Lastly, in most applications it will be desirable or necessary to provide a secondary combustion air flow through register 14 which forms an air envelope about the primary combustion air and the slurry spray cones to both limit the diameter of the flame downstream of the burner and prevent slurry particles from impacting on the furnace walls. The vanes 36 of the secondary register are adjustable so that the air can be co- or counter-rotated relative to the rotation of the air emitted by the main combustion air spinner to permit the control of the flame diameter.

We claim:

1. A method of introducing combustion air about an axially located fuel nozzle into a combustion chamber comprising the steps of:

flowing the combustion air axially downstream at a substantially uniform rate over its entire cross-section;

at about the location of the nozzle rotationally deflecting the combustion air flow concentrically with the axis of the nozzle at a rate which increases from adjacent the nozzle to a periphery of the air flow so that the air flow immediately downstream of the nozzle is substantially uniform over the entire cross-section of the air flow and so that the air flow forms a low pressure gradient downstream and radially outward of the nozzle which causes a radially outward deflection of the combustion air flow downstream of the nozzle;

whereby recirculating, hot combustion gases are drawn from a combustion chamber in an upstream direction towards the nozzle while the combustion air stream immediately downstream and in the vicinity of the nozzle prevents the recirculating combustion gases from contracting and fouling the nozzle.

2. A method of introducing combustion air about an axially located fuel atomizing nozzle comprising the steps of providing a ring-shaped combustion air spinner disposed about the nozzle;

flowing the combustion air into the spinner at a substantially uniform rate over its entire crosssection; and rotationally deflecting the combustion air as it flows through the spinner an amount which is least proximate the nozzle, greatest at a periphery of the spinner and which increases from the vicinity of the spinner to the periphery of;

whereby a low pressure gradient is generated in the combustion air flow downstream of the spinner and radially outward of the axis thereof which creates a low pressure vortex about the axis of the spinner axis downstream of the spinner; and whereby further combustion air emitted by the spinner in the vicinity of the nozzle is deflected radially outward and generally about the vortex at a point downstream of the spinner so that the vortex is prevented from extending in an upstream direction into contact with the spinner and the nozzle.

3. A combustion air spinner for use with a concentrically located fuel atomizing nozzle comprising a generally cylindrical housing adapted to be concentrically placed about the nozzle and a plurality of air flow deflecting vanes disposed within the housing and about the nozzle, each vane having a generally circularly arcuate shape in the air flow direction and an upstream facing end arranged so that it is substantially parallel to the air flow entering the housing, the vane having a length in the direction of air flow which is shortest in the vicinity of the nozzle and longest at the periphery of the vane; so that it imparts to the incoming air flow a rotational flow component which is lowest at a point of the vane which is radially closest to the nozzle and highest at a point of the blade which is radially furthest removed from the nozzle;

whereby the air flow over the entire cross-section of the spinner is substantially uniform and the air flow issuing from the spinner proximate the nozzle protects the nozzle against contact from recirculating combustion gases and the air flow, at a point downstream of the spinner and radially outward from the axis of the spinner, generates a low pressure gradient which deflects air issuing from the spinner outwardly to facilitate the recirculation of combustion gases in an upstream direction towards but short of the spinner and the nozzle.

4. A method according to claim 1 wherein the step of rotationally deflecting includes the step of imparting to the combustion air a rate of rotation which increases from the vicinity of the nozzle in a radial direction to the periphery of the air stream by a factor in the order of at least about 10.

5. A method according to claim 1 wherein the step of rotationally deflecting comprises the step of flowing the combustion air along a substantially circularly arcuate surface.

6. A method according to claim 1 wherein the step of rotationally deflecting the combustion air along a circularly arcuate surface comprises the step of flowing the air stream along a circularly arcuate surface which is shortest in the direction of flow at a point proximate the nozzle and longest at a point furthest removed from the nozzle.

7. A spinner according to claim 3 wherein each vane has a length in the air flow direction which increases as a function of the distance from the nozzle so that the vane imparts a spin number to the air flow which increases from the radially innermost and outermost points of the vanes by a factor in the order of at least about 10.

8. A spinner according to claim 3 wherein the spin number generated by the vanes at a point proximate the nozzle is about 0.4.

9. A spinner according to claim 8 wherein the spin number at the peripheries of the vanes is at least about 6.

10. A spinner according to claim 9 wherein a downstream edge of each vane is substantially straight.

11. A spinner according to claim 9 wherein a downstream edge of each blade has a concave configuration.

12. A spinner according to claim 9 wherein a downstream edge of each vane has a convex configuration.

* * * * *